US008397946B2

(12) United States Patent
Portney

(10) Patent No.: US 8,397,946 B2
(45) Date of Patent: Mar. 19, 2013

(54) CARTRIDGE BASED DISPENSER SYSTEM

(76) Inventor: Nathaniel G. Portney, La Jolla, CA (US)

( * ) Notice: Subject to any disclaimer, the term of this patent is extended or adjusted under 35 U.S.C. 154(b) by 292 days.

(21) Appl. No.: 12/840,010

(22) Filed: Jul. 20, 2010

(65) Prior Publication Data

US 2011/0253737 A1 Oct. 20, 2011

Related U.S. Application Data

(60) Provisional application No. 61/324,504, filed on Apr. 15, 2010.

(51) Int. Cl.
*G07F 11/00* (2006.01)

(52) U.S. Cl. ..... 221/113; 221/82; 221/88; 221/120; 221/287

(58) Field of Classification Search ..... 221/82, 221/88, 113, 119, 120, 121, 287
See application file for complete search history.

(56) References Cited

U.S. PATENT DOCUMENTS 3,297,198 A 1/1967 Wright, Jr.
4,165,709 A 8/1979 Studer
4,667,959 A * 5/1987 Pfeiffer et al. ..... 221/265
4,971,221 A 11/1990 Urquhart et al.
5,310,082 A 5/1994 Coustenoble
5,409,132 A * 4/1995 Kooijmans et al. ..... 221/86
5,575,392 A 11/1996 Cutler
5,931,302 A 8/1999 Isaacs et al.
6,651,840 B1 * 11/2003 Van Dullemen et al. ..... 221/88
7,104,417 B2 * 9/2006 Hilliard ..... 221/25
7,108,153 B2 * 9/2006 Wood ..... 221/15
7,129,819 B2 10/2006 Chiavetta et al.
7,581,657 B2 * 9/2009 Dickmann ..... 221/88
7,624,733 B2 * 12/2009 Riley et al. ..... 128/203.21
7,896,192 B2 * 3/2011 Conley et al. ..... 221/15

* cited by examiner

*Primary Examiner* — Timothy Waggoner
(74) *Attorney, Agent, or Firm* — Walter A. Hackler; Marc G. Martino

(57) ABSTRACT

A cartridge based dispensing system includes a cartridge having a rotatable compartmentalized receptacle for supporting a plurality of items in separate compartments along with a housing for removably supporting the cartridge. The housing includes an opening for enabling dispensing of an item from an aligned separate compartment and a mechanism is provided for rotating the receptacle within the cartridge in order to align compartments with the housing opening. The mechanism may be configured for causing different discrete angular rotations of the receptacle corresponding to compartment size.

15 Claims, 5 Drawing Sheets

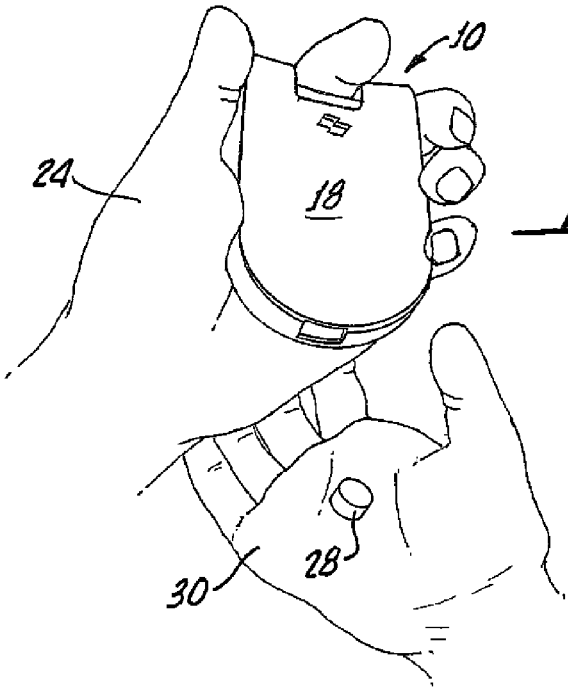
FIG. 1.
FIG. 2.
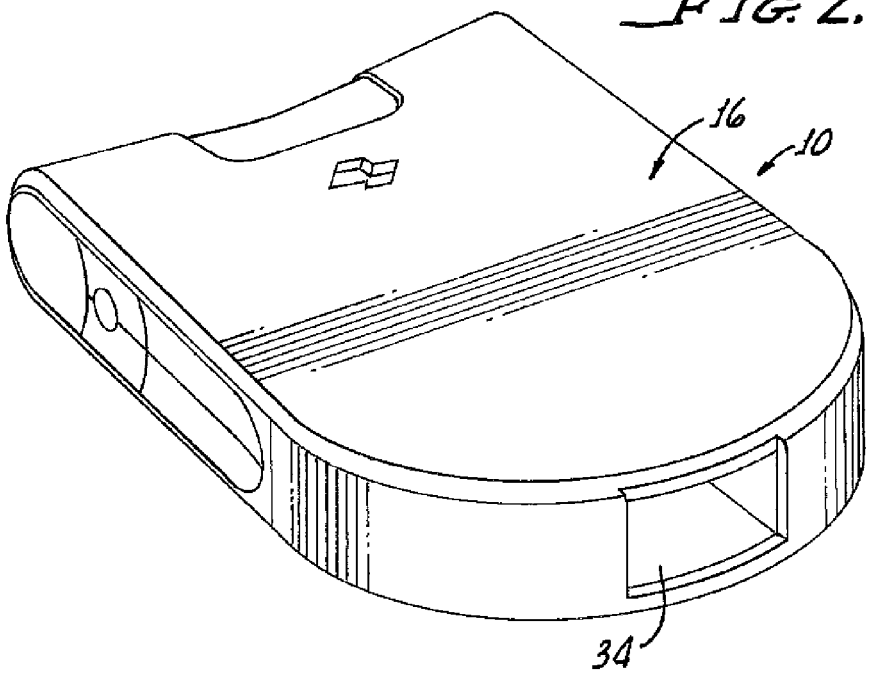

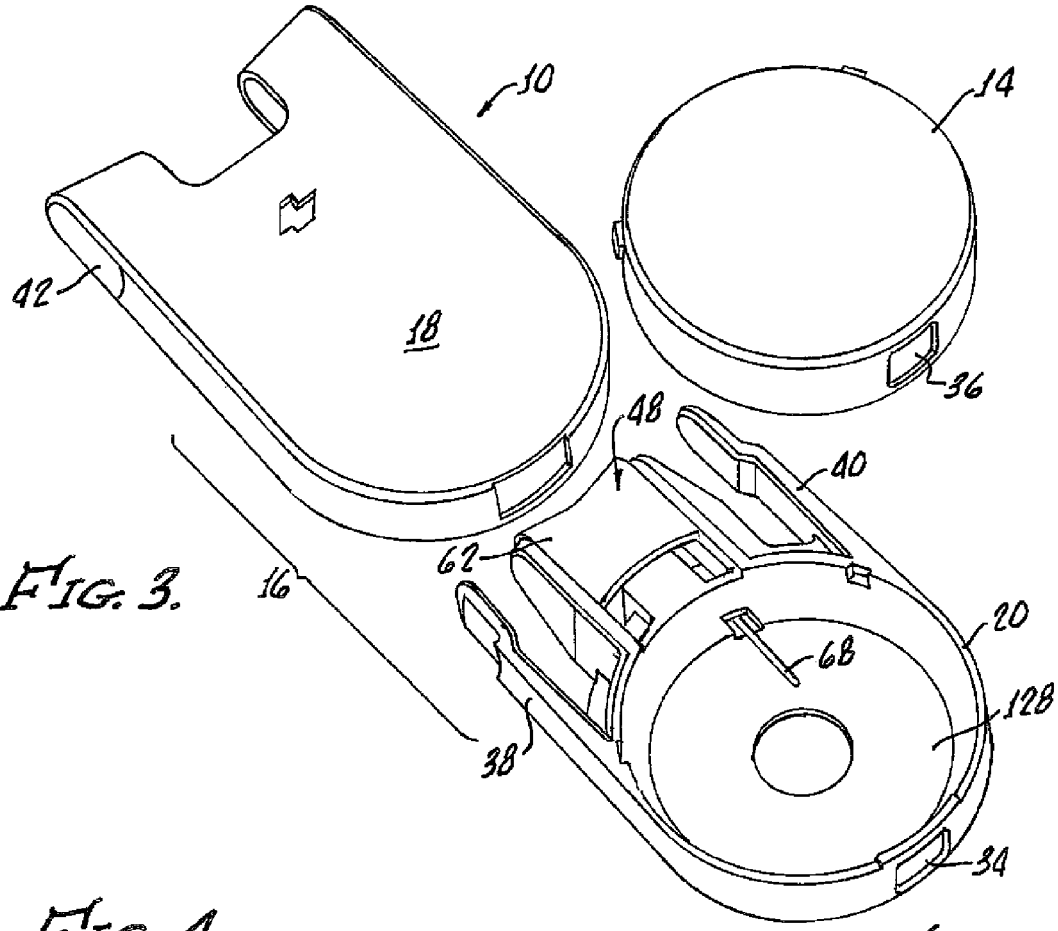
FIG. 3.
FIG. 4.
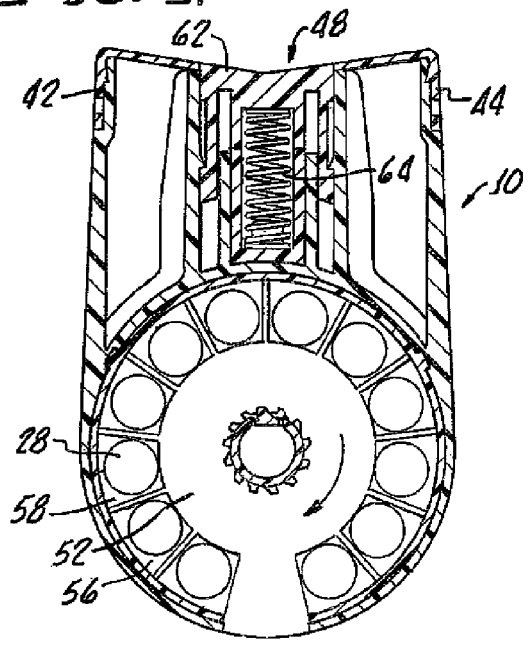
FIG. 5.
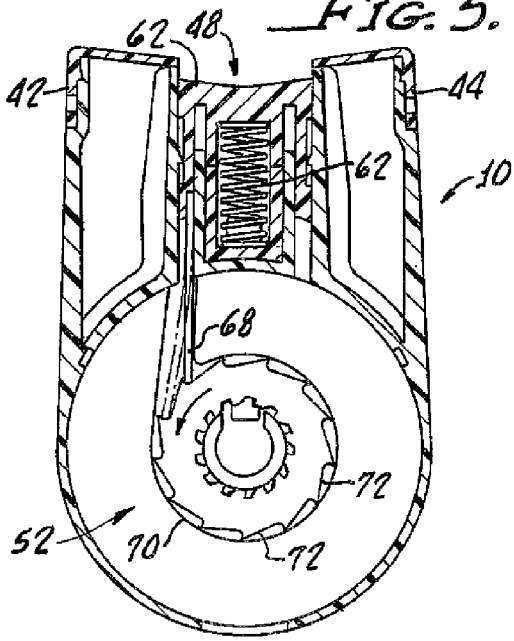

FIG. 7.
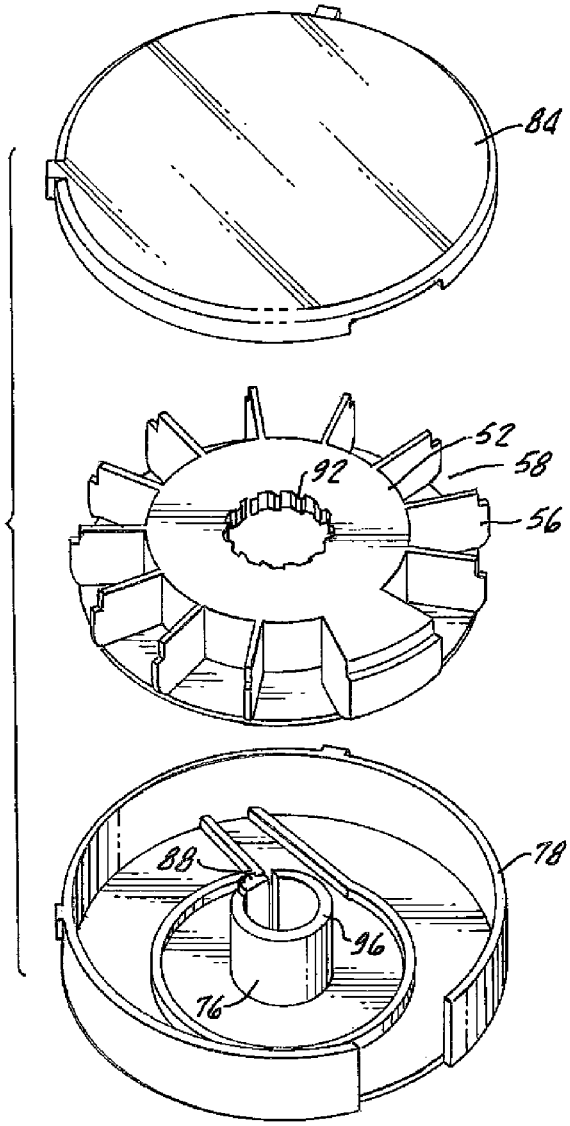
FIG. 6.
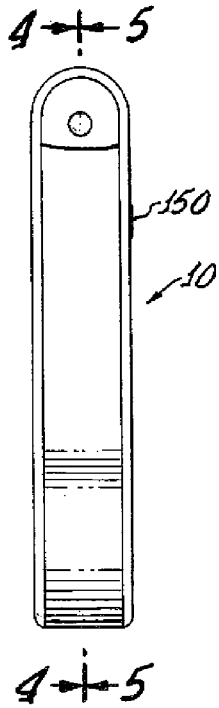
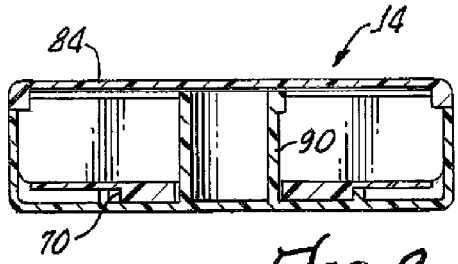
FIG. 9.
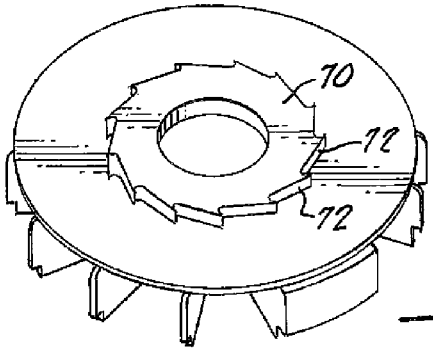
FIG. 8.

CARTRIDGE BASED DISPENSER SYSTEM

This application claims priority from U.S. Provisional Patent Application Ser. No. 61/324,504 filed Apr. 15, 2010. This application is to be incorporated in its entirety into the present application.

The present invention generally relates to cartridge based dispensing systems and is more particularly directed to a system for dispensing edibles, meaning any orally consumable product, for example but not limited to tablets, filled capsules, soft gels, mints, confections, food or feed stuffs, or any solid-form pharmaceutical product.

There are freshness issues in standard packaging today, which reduces the lifetime potency and quality of products. For example, soft gels, common in supplements today, clump together under moisture, soon after a bottle or package is opened, leading to consumer waste and often buyer's remorse.

These degradation issues are unavoidable in bottling systems commonly used in industry for variety of oral dosage formulations (e.g. soft gels, filled capsules, tablets). In addition, consumers typically pour our contents randomly, to extract a smaller quantity of product, thereby contributing contamination issues from excess handling.

Exposure to moisture and air causes faster spoilage and degradation of product contents in standard bottle packaging. Blister packaging has been developed to overcome such problems, however, even well partitioned blister cards, require manual handling of product, and often times, cumbersome hole puncture. Soft container systems commonly used as last resort by consumers, often undergo breakage during transport, cross-contamination due to lack of partitioning of contents inside.

The present invention provides more convenient release of product, minimal consumer handling, and improved lifetime, freshness, and potency of packaged product compared to current packaging systems available. Each edible is segregated from each other, thereby preventing co-adhesion, breakage, and mutual degradation of product. Handling conveniences in general, are improved with the present invention because contents need not be poured out in uncontrolled ways, contributing to spoilage, and delay to customer relief.

Also, contamination issues are avoided, because a dispensering system in accordance with the present invention allows a customer to release a controlled serving, through a simple clicking action. The present invention provides for product freshness and protects unused supply from moisture this improving lifetime and potency of remaining supplies.

SUMMARY OF THE INVENTION

A cartridge based dispensing system in accordance with the present invention generally includes a cartridge having a rotatable compartmentalized receptacle for supporting a plurality of items in separate compartments.

A housing is provided for removably supporting the cartridge with the housing having an opening for enabling dispensing of an item from an aligned separate compartment.

A mechanism is also provided for rotating the receptacle in order to align the compartments with the housing opening. Importantly, the mechanism may be configured for causing a different discrete angular rotations of the receptacle corresponding to compartment size. This, in turn, enables the system to dispense items of different sizes, which are supported in different sized compartments.

In that regard, the system in accordance with the present invention may include a plurality of cartridges with each cartridge having a rotatable compartmentalized receptacle with different sized compartments. Each of these receptacles are configured for cooperating with the mechanism for causing different discrete angular rotations of each receptacle corresponding to a compartment sized of each of the receptacles.

More particularly, the mechanism may include a linear actuator for rotating the receptacle. In that regard, a biased depressible button with an attached push rod may be provided and each receptacle configuration may include a sprocket disposed for engagement by the push rod for rotation of the receptacle. A number of sprocket teeth of each corresponding receptacle is correlated to a number of compartments in the corresponding receptacle. Further, the button and housing opening may be disposed on opposite ends of the housing for facilitating one hand operation of the dispensing system.

Still more particularly, the housing may comprise a frame and a carrier with the carrier being insertable into the frame and having, in turn, a cavity for receiving the cartridge. Specifically, the cartridge may comprise a bottom shell with a base recess for receiving the receptacle sprocket and push rod along with an upstanding perimeter sidewall for surrounding a receptacle. The sidewall includes an opening alignable with the housing opening and an upstanding central hub is provided for rotatably mounting the receptacle along with a cover for sealing the receptacle within the cartridge.

More specifically, a dog may be disposed at a top of the hub along with a ratchet disposed at a top of the receptacle and engaging the dog for enabling one-way rotation of the receptacle within the cartridge.

The present invention further extends to a cartridge for use in a dispensing system such as the one hereinabove described. The cartridge in accordance with the present invention includes a compartmentalized receptacle for receiving a plurality of items in separate compartments along with a sprocket disposed at a bottom of the receptacle, which includes a number of sprocket teeth correlated to a number of the compartments.

A bottom shell is provided with a base recessed for receiving the receptacle sprocket and upstanding perimeter sidewall surrounds the receptacle with the sidewall having an open and alignable with a receptacle compartment. An upstanding central hub is provided for rotatably mounting the receptacle within a sidewall and a cover is also provided for sealing the receptacle within the cartridge.

Further included in the present invention is a dispenser for a cartridge having a rotatable compartmentalized receptacle for supporting a plurality of items in separate compartments. The dispenser in accordance with the present invention includes a housing for removably supporting the cartridge with the housing having an opening for enabling dispensing of an item from an aligned separate compartment. A mechanism is provided for rotating the receptacle in order to align the compartments with the housing opening with the mechanism being configured for enabling discrete angular rotations of the receptacle corresponding to the compartment sized.

It follows that a method in accordance with the present invention includes providing a cartridge having a rotatable compartmentalized receptacle for supporting a plurality of items in separate compartments; providing a housing for removably supporting said cartridge, said housing having an opening for enabling dispensing of an item from an aligned separate compartment; providing a mechanism for rotating the receptacle within the cartridge in order to align the compartments with the housing opening; and configuring said mechanism for causing different discrete angular rotations of the receptacle corresponding to compartment size.

More particularly, the method in accordance with the present invention includes providing a cartridge having a rotatable compartmentalized receptacle for supporting a plurality of items in separate compartments; providing a housing for removably supporting said cartridge, said housing having an opening for enabling dispensing of an item from an aligned separate compartment; and providing a mechanism for rotating the receptacle within the cartridge in order to align the compartments with the housing opening; configuring said mechanism with a biased depressible button with an attached push rod; and configuring a receptacle with a sprocket disposed for engagement by the push rod for rotating the receptacle.

BRIEF DESCRIPTION OF THE DRAWINGS

The present invention may be better understood with reference to the following detailed description when taken in conjunction with the accompanying drawings, in which:

FIG. 1 illustrates a dispensing system in accordance with the present invention and method of operation for dispensing a pill into the hand of a user, the pill may also be directed to a mouth of a user (not shown) in which case the system enables release of the pill without any manually handling thereof;

FIG. 2 is a perspective view of the dispensing system shown in FIG. 1 also illustrating a housing along with a depressible button shown opposite an opening for dispensing of items with the opposed nature of the button and opening facilitating one hand operation of the dispensing system as shown in FIG. 1;

FIG. 3 is an exploded view of the dispensing system shown in FIGS. 1 and 2 illustrating the housing as having a frame and a carrier along with the removable cartridge and a mechanism for rotating the receptacle within the cartridge;

FIG. 4 is a partial cross section of the dispensing system in accordance with the present invention illustrating a top of a cartridge disposed within the housing carrier;

FIG. 5 is a cross sectional view similar to that shown in FIG. 4 illustrating a bottom of the cartridge disposed in the housing carrier;

FIG. 6 is a side view of the dispensing system also indicating sectional lines for FIGS. 4 and 5;

FIG. 7 is an exploded view of a cartridge in accordance with the present invention including a rotatable compartmentalized receptacle;

FIG. 8 is a perspective view showing a bottom of the receptacle shown in FIG. 7;

FIG. 9 is a cross sectional view of the cartridge in accordance with the present invention;

DETAILED DESCRIPTION

Figure 10:
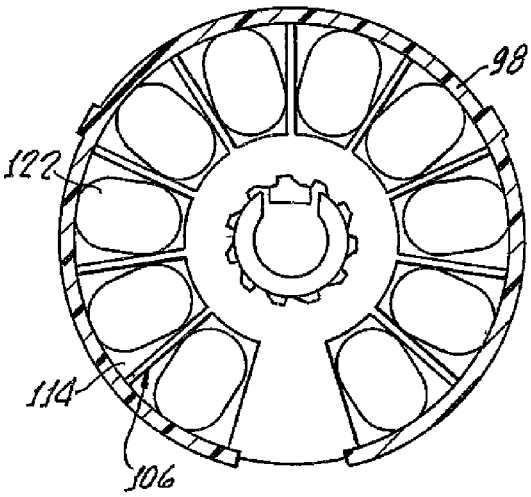
FIGS. 10 and 11 illustrate rotation of a ten-compartment receptacle.

With reference to FIGS. 1-3, there is shown a cartridge base dispensing system 10 in accordance with the present invention generally illustrating a cartridge 14 and housing 16 with the housing 16 including a frame 18 and a carrier 20 for receiving the cartridge 14.

With reference to FIG. 1, the dispensing system 10 is pocket portable and ergonomically designed to fit into the palm of a hand 24 for releasing an item, such as a pill 28 into another hand 30 of a user. The illustrated operation of the dispensing system 10 enables faster time-to-relief for a patient when relief is a critical factor. This is important, for example, for the allergy medication and other fast response (TC/Rx), or time sensitive supplementation instances, where access and portability is a mission critical to the user. It should be appreciated that many high end and capable systems available today are bulky, require advanced knowledge to operate, and often have cumbersome operation procedures, which do not lend themselves to efficient use.

With reference again to FIG. 3, the carrier 20 includes an opening 34 alignable with a cartridge opening 36 for enabling dispensing of the pill 28 (not shown in FIG. 3) as will be hereinafter described in greater detail.

The carrier 20 further extending spring-like fingers 38, 40 for releasably engaging ends 42, 44 of the frame 18, see also FIGS. 4 and 5. The release of the carrier 20 from the frame 18 is enabled by squeezing of the fingers 38, 40.

A mechanism 48 is provided for rotation of a receptacle within the cartridge 14 in order to align separate compartments 56, 58 with the housing opening 34.

This rotation is caused through a linear actuator, such as, for example only, a depressible button 62 of the button 62 being biased by a spring.

The mechanism 48 is configured by way of a push rod 68, interconnected with the button 62, and a receptacle 52 configuration including a sprocket 70 disposed for engagement by the push rod 68 with the sprocket having teeth correlated to a number of compartments 56, 58 in an inserted receptacle 52. It should be appreciated that the push rod 68 displacement can be increased to allow the ejection of multiple items 28 under a single button 62 depression.

It should be appreciated that while the mechanism 148 is illustrated as being implemented through use of a manually depressible button 62, other configurations may be utilized to operate the push rod 48 and sprocket 70 including electric or electronic devices, not shown. It is important, however, that the mechanism is configured for causing different discrete angular rotations of the receptacle 52 corresponding to compartment 56 of size.

With reference now to FIGS. 7-9, there is shown the cartridge 14 with the receptacle 52 being mounted for rotation within the cartridge 14 via a hub 76. A perimeter sidewall 78 having an opening 80 alignable with the carrier opening 34 enables sealing of the receptacle 52 within the cartridge 40 by way of a cover 84. Reverse rotation of the receptacle 52 within the cartridge 14 is prevented through the use of a dog 88 disposed at a half top 90 of the hub 76 and engagable with a ratchet 92 disposed at a top 94 of the receptacle 52.

Figure 11:
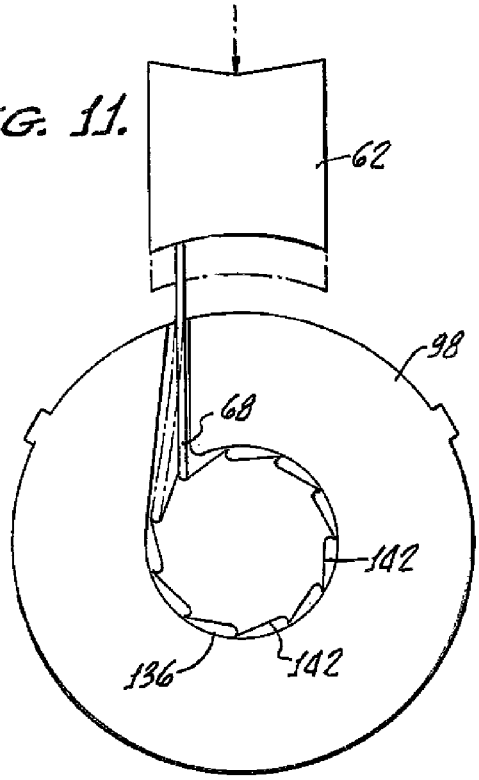
Figure 12:
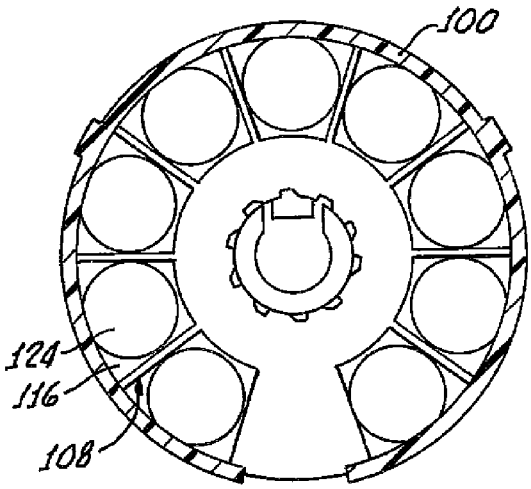
FIGS. 12-13 illustrate a rotation of a nine-compartment receptacle.
Figure 13:
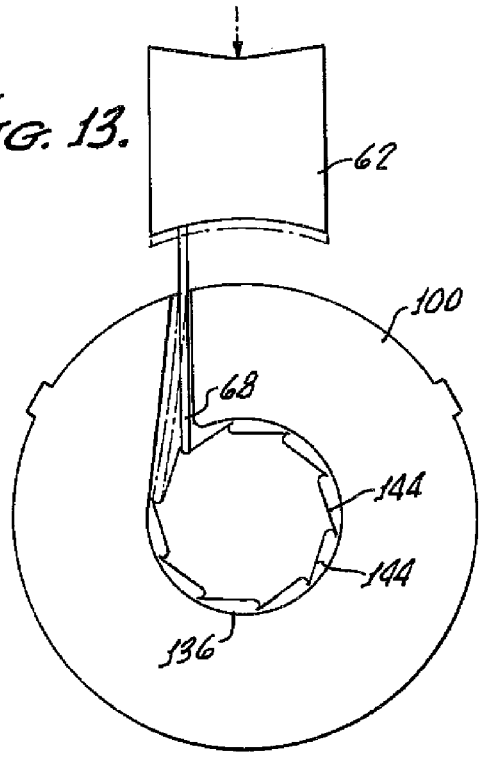
Figure 14:
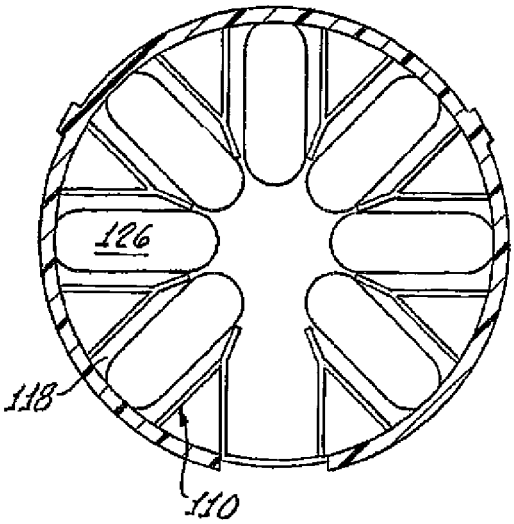
FIGS. 14-15 illustrate a rotation of a seven-compartment receptacle.
Figure 15:
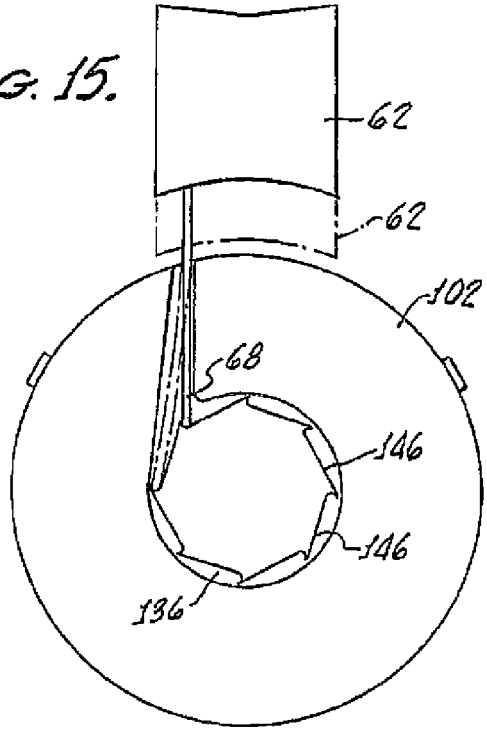

The present invention further encompasses multiple cartridges 98, 101, 102, see FIGS. 10-15, with corresponding receptacles 106, 108, 110 each having different sized compartments 114, 116, 118 which may be also shaped to accommodate different sized pills or capsules 122, 124, 126 separated.

Each of the receptacles 52, 106, 108, are sized for an insertion into a carrier cavity 128, see FIG. 3, with a sprocket 70, 134, 136, 138 engaging a push rod 68. Importantly, the number of teeth 72, 142, 144, 146 are correlated with compartment 56, 114, 166, 118, there being n compartments 56, 114, 116, 118 for n+1 teeth 172, 142, 144, 146.

Rotation of the receptacles 156, 106, 108, 110 is illustrated in FIGS. 10-15 and common reference numbers indicating elements of the present invention hereinbefore described.

An indicator or a window 150, see FIG. 6 may be utilized to either indicate a number of compartments 56, 114, 116, 118 emptied, the window enabling observation of an indicia (not shown). On the cartridges 114, 98, 100, 102, or receptacle 52, 106, 108, 110. Other types of electronic communication may be established with the use of the system in accordance with the present invention.

Benefits of System:

Having a cartridge 14 format allows containment of edibles 28 inside fresher by the time they reach consumer intake. Instead of having one bottle with sixty units, exposed to air, smaller increments (with freshness seal) can avoid this effect by discretizing the increments for consumer intake.

The system enables discreetness to the user, by concealing the brand label, while it is stored inside the dispenser. This will protect against personal privacy in what product the user is taking. Products that are normally embarrassing are shielded from public view, when consumer uses this dispenser system.

The system can be created to enable cartridge swapping during intermediate depleted states. This enables the user to swap out cartridges of multiple products, without having to finish the current product, allowing them to conceivably use a single dispenser for multiple products.

The system has passive child safety locking system—Each independent cartridge requires the dispenser to engage release. Otherwise, the user cannot readily eject edibles from inside a naked cartridge. Therefore, the consumer can freely store cartridge reserves in presence of children, while storing their dispenser in a private location. Also, parents can issue a single cartridge to their children, to limit the edibles they consume, by conversely controlling the supply of cartridges they can access.

The system is pocket portable—dimensions of product is pocket portable and conveniently addressed by pushing a large button on the side. This can have audible feedback as well as visual feedback (color changes) during operation. This system is superior to alternatives that are immobile, and lack the durability of current systems.

The system helps protect edibles by storage in dark location within the dispenser cavity. The dark and dry state helps further insulate the edibles from harsh ambient conditions (heat, cold, water, and contamination).

The system enables direct to mouth dispensing, avoiding possible contamination handling by manual operation.

The system has an indicator on the rear, which helps the consumer predict the timing of dosages. This in cartridge molded number increases by an increment during each button ejection procedure. The system can be tailored to the type of VMS or medication being consumed, to help the consumer coordinate intake scheduling.

The pocket portable convenience system of dispenser improves compliance of the product intake, which can be extended into medication and OTC. Medical community can request more stringent requirements, and the convenient system enables the patient to better comply to such requests, rather than actively recalling to take their product.

The portable dispensing system enables a segment of athletes and consumers in fitness to improve their timing of midday supplement products. Normally, these segments intake majority of their products in the morning and evening, due to midday activities. With this portable and convenient dispenser system, the consumer can time very stringent intake scheduling in the midday, to improve their health regimen.

Although there has been hereinabove described a specific cartridge based dispensing system in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A cartridge based dispensing system comprising:

a cartridge having a rotatable compartmentalized receptacle for supporting a plurality of items in separate compartments;

a housing for removably supporting said cartridge, said housing having an opening for enabling dispensing of an item from an aligned separate compartment; and a mechanism for rotating the receptacle within the cartridge in order to align the compartments with the housing opening, said mechanism being configured for causing different discrete angular rotations of the receptacle corresponding to compartment size, said mechanism comprises a biased depressible button with an attached push rod and the receptacle includes a sprocket disposed for engagement by the push rod for rotating of the receptacle with a number of sprocket teeth correlated to a number of compartments in the receptacle, being disposed on opposite ends of said housing for facilitating one-hand operation of the dispensing system.

2. The system according to claim 1 further comprising a plurality of cartridges each cartridge having a rotatable compartmentalized receptacle with different sized compartments, with each receptacle being configured for cooperating with said mechanism for causing different discrete angular rotations of each receptacle corresponding to a compartment size of each of the receptacles.

3. The system according to claim 2 wherein said mechanism includes a linear actuator for rotating the receptacle.

4. The system according to claim 1 wherein said mechanism includes a linear actuator for rotating the receptacle.

5. The system according to claim 1 wherein said housing comprises a frame and a carrier, insertable into said frame, having a cavity for receiving the cartridge, the housing opening being disposed in said carrier.

6. The system according to claim 1 wherein the cartridge comprises a bottom shell with a base recessed for receiving the receptacle sprocket and the push rod, an upstanding perimeter sidewall for surrounding the receptacle, the sidewall having an opening alignable with the housing opening, an upstanding central hub for rotatably mounting said receptacle, and a cover for sealing the receptacle within said cartridge.

7. The system according to claim 6 further comprising a dog disposed at a top of the hub and a ratchet disposed at a top of the receptacle and engaging the dog for enabling one way rotation of the receptacle within said cartridge.

8. The system according to claim 1 wherein said housing comprises a frame and a carrier, insertable into said frame, having a cavity for receiving the cartridge, the housing opening being disposed in said carrier.

9. The system according to claim 8 wherein said cartridge comprises a bottom shell with a base recessed for receiving the receptacle sprocket and the push rod, an upstanding perimeter sidewall for surrounding the receptacle, the sidewall having an opening alignable with the housing opening, an upstanding central hub for rotatably mounting said receptacle and a cover for sealing the receptacle within said cartridge.

10. The system according to claim 9 further comprising a dog disposed at a top of the hub and a racket disposed at a top of the receptacle and engaging the dog for enabling one way rotation of the receptacle within the cartridge.

11. The system according to claim 9 wherein the button and housing opening are disposed on opposite ends of said housing for facilitating one-hand operation of the dispensing system.

12. A cartridge for use in a dispensing system, said cartridge comprising:

a compartmentalized receptacle for supporting a plurality of items in separate compartments;

a sprocket, disposed at a bottom of the receptacle, having a number of sprocket teeth correlated to a number of compartments;

a bottom shell with a base recessed for receiving the receptacle sprocket;

an upstanding perimeter sidewall for surrounding the receptacle, the sidewall having an opening alignable with a receptacle compartment;

an upstanding central hub for rotatably mounting said receptacle within the sidewall; and a cover for sealing the receptacle within the cartridge.

13. The cartridge according to claim 12 further comprising a dog disposed at a top of the hub and a racket disposed at a top of the receptacle and engaging the dog for enabling one way rotation of the receptacle within said cartridge.

14. A dispenser for a cartridge having a rotatable compartmentalized receptacle for supporting a plurality of items in separate compartments, said dispenser comprising:

a housing for removably supporting said cartridge, said housing having an opening for enabling dispensing of an item from an aligned separate compartment; and a mechanism for rotating the receptacle in order to align the compartments with the housing opening, said mechanism being configured for enabling discrete angular rotations of the receptacle corresponding to compartment size, wherein said mechanism comprises a biased dispensable button for rotation of the receptacle, wherein the button and housing opening are disposed on opposite sides of said housing for facilitating, one-hand operation of the dispenser.

15. The dispenser according to claim 14 wherein said housing comprises a frame and a carrier, insertable into said frame, having a cavity for receiving the cartridge, the housing opening being disposed in said carrier.

* * * * *